US008984764B2

(12) United States Patent
Rae et al.

(10) Patent No.: US 8,984,764 B2
(45) Date of Patent: Mar. 24, 2015

(54) INK CURING APPARATUS

(71) Applicant: GEW (EC) Limited, Redhill Surrey (GB)

(72) Inventors: Malcolm Rae, Redhill Surrey (GB); James Hicks, Redhill Surrey (GB)

(73) Assignee: GEW (EC) Limited, Redhill Surrey (GB)

( * ) Notice: Subject to any disclaimer, the term of this patent is extended or adjusted under 35 U.S.C. 154(b) by 0 days.

(21) Appl. No.: 14/352,547

(22) PCT Filed: Feb. 21, 2013

(86) PCT No.: PCT/GB2013/050417

§ 371 (c)(1),
(2) Date: Apr. 17, 2014

(87) PCT Pub. No.: WO2013/128165

PCT Pub. Date: Sep. 6, 2013

(65) Prior Publication Data

US 2014/0245628 A1 Sep. 4, 2014

(30) Foreign Application Priority Data

Feb. 28, 2012 (GB) ..... 1203460.9

(51) Int. Cl.

| | |
|---|---|
| ***F26B 3/00*** | (2006.01) |
| ***B41F 23/04*** | (2006.01) |
| ***B41J 11/00*** | (2006.01) |
| ***F26B 3/28*** | (2006.01) |

(52) U.S. Cl.

CPC ..... *B41F 23/04* (2013.01); *B41F 23/0409* (2013.01); *B41J 11/002* (2013.01); *F26B 3/28* (2013.01); *B41F 23/0453* (2013.01)

USPC ..... 34/274; 34/278; 101/424.1; 347/102; 362/283

(58) Field of Classification Search

USPC ..... 34/274, 277, 278; 250/492.1, 504 R; 101/424.1, 488; 347/102; 362/283

See application file for complete search history.

(56) References Cited

U.S. PATENT DOCUMENTS

| | | | | |
|---|---|---|---|---|
| 3,733,709 | A * | 5/1973 | Bassemir et al. | 34/277 |
| 3,819,929 | A * | 6/1974 | Newman | 362/218 |
| 4,025,795 | A * | 5/1977 | Lackore et al. | 250/504 R |
| 5,502,310 | A | 3/1996 | Niestrath et al. | |
| 8,038,282 | B2 * | 10/2011 | Claeys | 347/102 |
| 2013/0093322 | A1 * | 4/2013 | Borsuk et al. | 315/39.51 |
| 2014/0245628 | A1 * | 9/2014 | Rae et al. | 34/277 |

FOREIGN PATENT DOCUMENTS

| | | | |
|---|---|---|---|
| DE | 10109061A1 | A1 | 10/2001 |
| DE | 102008058056 | A1 | 7/2010 |
| EP | 0597162 | A1 | 5/1994 |
| GB | 2336895 | A | 3/1999 |
| GB | 2360084 | A | 9/2001 |
| GB | 2444328 | A | 7/2008 |
| WO | 2008/073338 | A2 | 6/2008 |

* cited by examiner

*Primary Examiner* — Steve M Gravini

(74) *Attorney, Agent, or Firm* — Nixon Peabody LLP; David S. Resnick; Mark J. FitzGerald

(57) ABSTRACT

An ink curing apparatus (11) comprising a UV light source (13); at least one moveable shutter means (17, 17*a*), which is moveable about the longitudinal axis of the UV light source (13); and at least one reflector (15); wherein at least one air passage (19*a*) is defined along substantially the entire surface area of the or each reflector (15).

10 Claims, 5 Drawing Sheets

INK CURING APPARATUS

CROSS REFERENCE TO RELATED APPLICATIONS

This application is a 35 U.S.C. 371 National Stage Application of International Application No. PCT/GB2013/050417, filed Feb. 21, 2013, which designates the United States, and which claims the benefit of foreign priority under 35 U.S.C. 119(e) of EP Application No. 1203460.9 filed Feb. 28, 2012, the contents which are herein incorporated by reference in their entireties.

The present invention relates to an ink curing apparatus and an improved cooling system for the ink curing apparatus.

Ink curing apparatus comprising a housing containing a lamp partially surrounded by reflectors to direct UV radiation onto a substrate to cure ink are well-known. A significant amount of heat is produced by the apparatus during the curing process and the housing usually contains a cooling system to compensate for the intense heat emitted from the lamp. The ability to cool the apparatus affects not just the life of the apparatus, but its running parameters, the ease with which the lamp can be controlled and the efficiency of the lamp. However, it has been found that even with air and/or water cooling used in existing systems, for example wherein an air/water channel runs longitudinally through the reflector, the efficiency of the apparatus is greatly reduced by the amount of heat produced. Insufficient cooling of the apparatus increases the required power input and the cost of running the apparatus. Furthermore, it has been found that prior art systems using air cooling can detrimentally affect the quality of the cured product. For example, when air is drawn into the apparatus from the "front" of the device, i.e. from the substrate, contaminants are pulled into the apparatus from the substrate. An increase in contaminants pulled into the system reduces the quality of the cured product, reduces the efficiency of the apparatus, and increases the time and cost of maintenance.

Existing ink curing apparatus use fixed reflectors to direct UV radiation from the lamp onto the substrate. The lamp is commonly surrounded by a rotating shutter. The shutter functions as a safety device, whereby when the apparatus is stopped and the power to the lamp is switched off the shutter is closed and shields the substrate from the heat of the lamp. When the power is switched off any residual heat in the lamp is retained within the apparatus, including being absorbed by the shutter. When the apparatus is switched back on to resume curing, the cooling system of the apparatus is required to remove any residual heat and cool the shutter, in addition to the reflectors. During use, a UV lamp emits heat at around 750° C. and a significant amount of heat will be retained even after the power is switched off. This means that in a "standby" mode, the UV lamp has to be totally switched off or, at least its power significantly reduced to reduce the heat that is absorbed and retained by the shutter. This significant reduction in the lamp's power in standby mode increases the time and power needed to increase the power to the lamp when the curing process is resumed.

The present invention sets out to provide an improved ink curing apparatus, which alleviates the problems described above to provide much improved cooling of the apparatus, which reduces the required power input.

In one aspect, the invention provides an ink curing apparatus comprising a UV light source; at least one moveable shutter means, which is moveable about the longitudinal axis of the UV light source; and at least one reflector; wherein at least one air passage is defined along substantially the entire surface area of the or each reflector.

It is to understand that "substantially" refers to a greater part. Preferably, the at least one air passage is defined along more than about 50% of the entire surface area of the or each reflector. More preferably, the at least one air passage is defined along more than about 70% of the entire surface area of the or each reflector. Still more preferably, the at least one air passage is defined along more than about 80% of the entire surface area of the or each reflector.

By maximising the surface area of the reflector that is exposed to cool air, the cool air travels around the heated reflector for a longer time and the efficiency of cooling is much improved. By improving the cooling of the apparatus, particularly around the reflector surfaces, which are the hottest part of the apparatus, a significant energy saving is made. The apparatus of the present invention requires a much lower power input and can achieve a significantly higher curing rate in terms of the UV power output (W/cm).

Preferably, the air passage is defined along substantially the entire surface area of the rear face of the reflector.

By cooling the rear face of the reflector the cooling of the hottest part of the apparatus is maximised without interfering with the UV radiation emitted from the UV light source, which is incident on the front face of the reflector. It is to be understood that the "front" face of the reflector is that nearest to the UV light source and the "rear" face of the reflector is that facing away from the UV light source.

Preferably, the at least one air passage also passes along a substantial part of the surface area of the or each shutter means.

Again, it is to understand that "substantial" refers to a greater part. Preferably, the at least one air passage is defined along more than about 50% of the surface area of the or each shutter means. More preferably, the at least one air passage is defined along more than about 70% of the surface area of the or each shutter means. Still more preferably, the at least one air passage is defined along more than about 80% of the surface area of the or each shutter means.

By cooling the shutter/s in addition to the reflector, the apparatus is cooled when the shutter means is both open and closed. The shutter has been found to retain a significant amount of heat when in a closed position, shielding the substrate from the lamp. By cooling the shutter, the lamp can also be powered when in "stand-by" mode, such that the lamp can be more quickly and efficiently ready for curing when curing is resumed.

Preferably, the ink curing apparatus comprises at least two shutter means.

Preferably, the ink curing apparatus comprises at least two reflectors.

Preferably, each reflector means is connectable to a shutter means, wherein an air passage is defined between each shutter means and the reflector to which it is connected.

Preferably, each reflector is removably connected to the shutter means.

By allowing the reflector to be easily removed from the apparatus, the cost and time involved in maintaining the apparatus is reduced.

Preferably, the or each reflector is moveable.

By allowing the reflector to move, the reflector can act or assist in shielding of the substrate from the lamp when the apparatus is in a closed position.

Preferably, a curing aperture is defined between the reflectors and the ink curing apparatus comprises an inlet to the or each air passage, wherein the inlet is positioned away from the curing aperture.

By positioning the air inlet away from the curing aperture the risk of contaminants from a substrate to be cured entering the apparatus is reduced. This improves the quality of the cured product, increases the efficiency of the apparatus, and reduces the time and cost of maintenance.

Preferably, the geometry of the or each reflector is designed to optimise UV intensity and dose with maximum recovery behind the lamp.

Preferably, the or each reflector is formed from glass or aluminium.

Preferably, the or each reflector is coated to maximise UV reflectivity and minimise IR reflectivity.

Preferably, the or each reflector is movably connected to the apparatus by means of at least one drive pin positioned along the length of the reflector.

Preferably, the or each reflector is fixed to the drive pin by a fixing pin positioned substantially half way along the length of the or each reflector.

The reflectors of known curing systems are fixed to the apparatus by a drive pin having fixing pins at each end of each reflector. The heat generated by the UV lamp incident on the reflectors causes the reflectors to expand. Expansion of the reflectors along their length and the heat conducted through the reflectors causes the fixing pins at each end of the reflector to expand, putting pressure on the fixings and limiting the possible expansion of the reflectors. The improved drive-pin/fixing pin arrangement of the present invention allows the reflector/s to expand when they are heated without excess pressure being placed on the drive-pin/s.

For the purposes of clarity and a concise description, features are described herein as part of the same or separate embodiments; however it will be appreciated that the scope of the invention may include embodiments having combinations of all or some of the features described.

Within this specification, the term "about" means plus or minus 20%, more preferably plus or minus 10%, even more preferably plus or minus 5%, most preferably plus or minus 2%.

The invention will now be described by way of example with reference to the accompanying diagrammatic drawings, in which.

Figure 1:
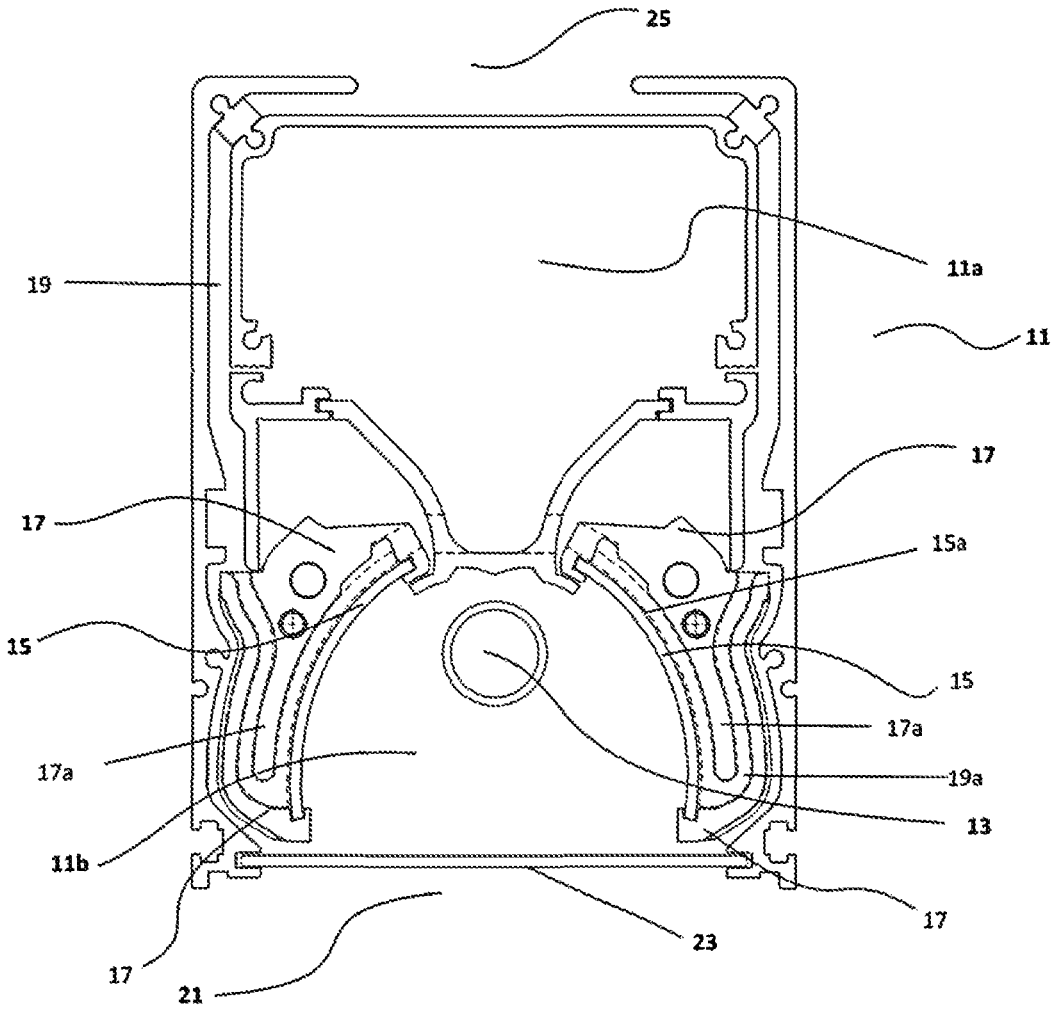
FIG. 1 is a cross-sectional view through an ink curing apparatus constructed in accordance with the present invention, showing the shutters in an open position.
Figure 2:
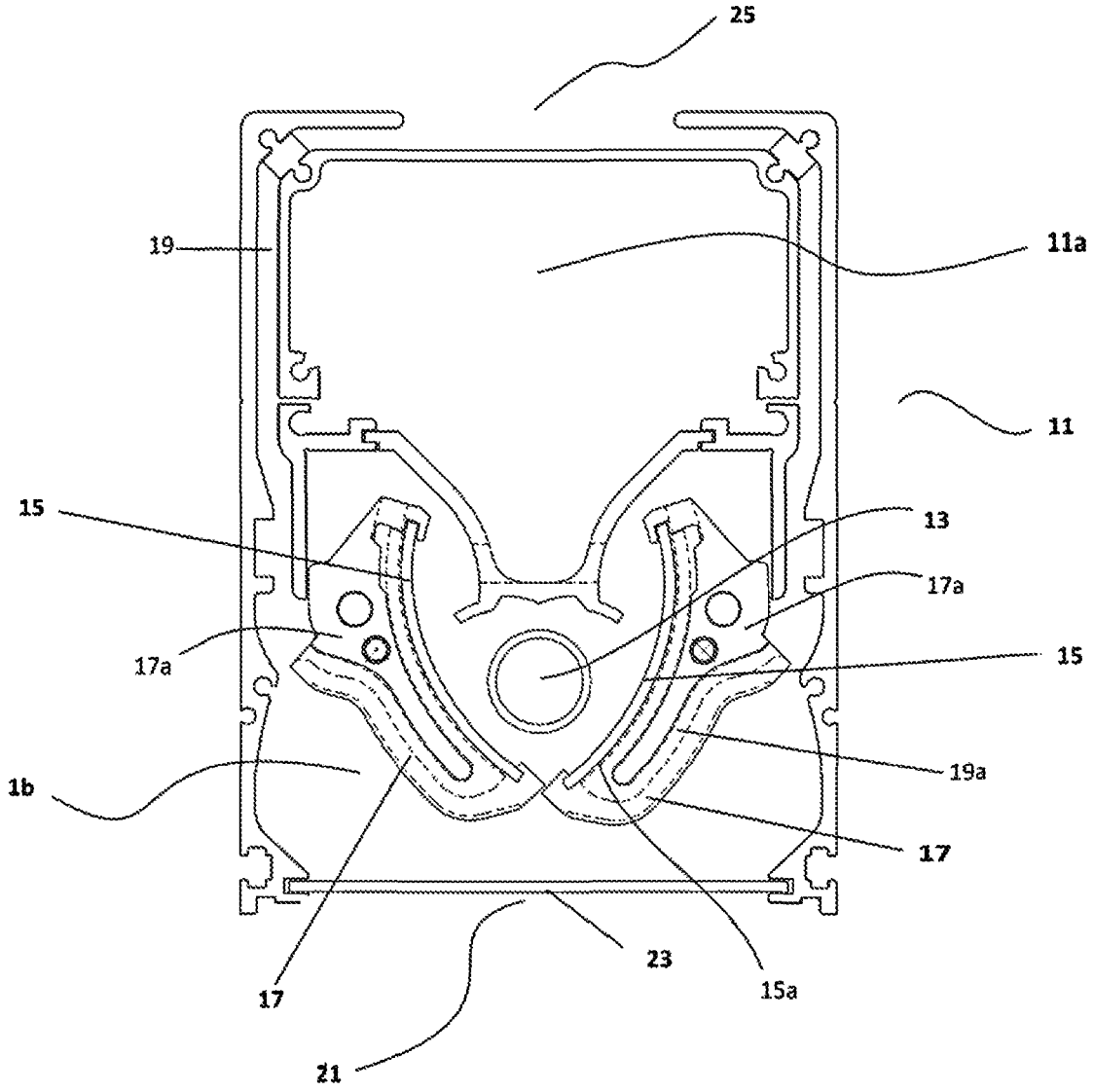
FIG. 2 is a cross-sectional view of the ink curing apparatus of FIG. 1, showing the shutters in a closed position.
Figure 4:
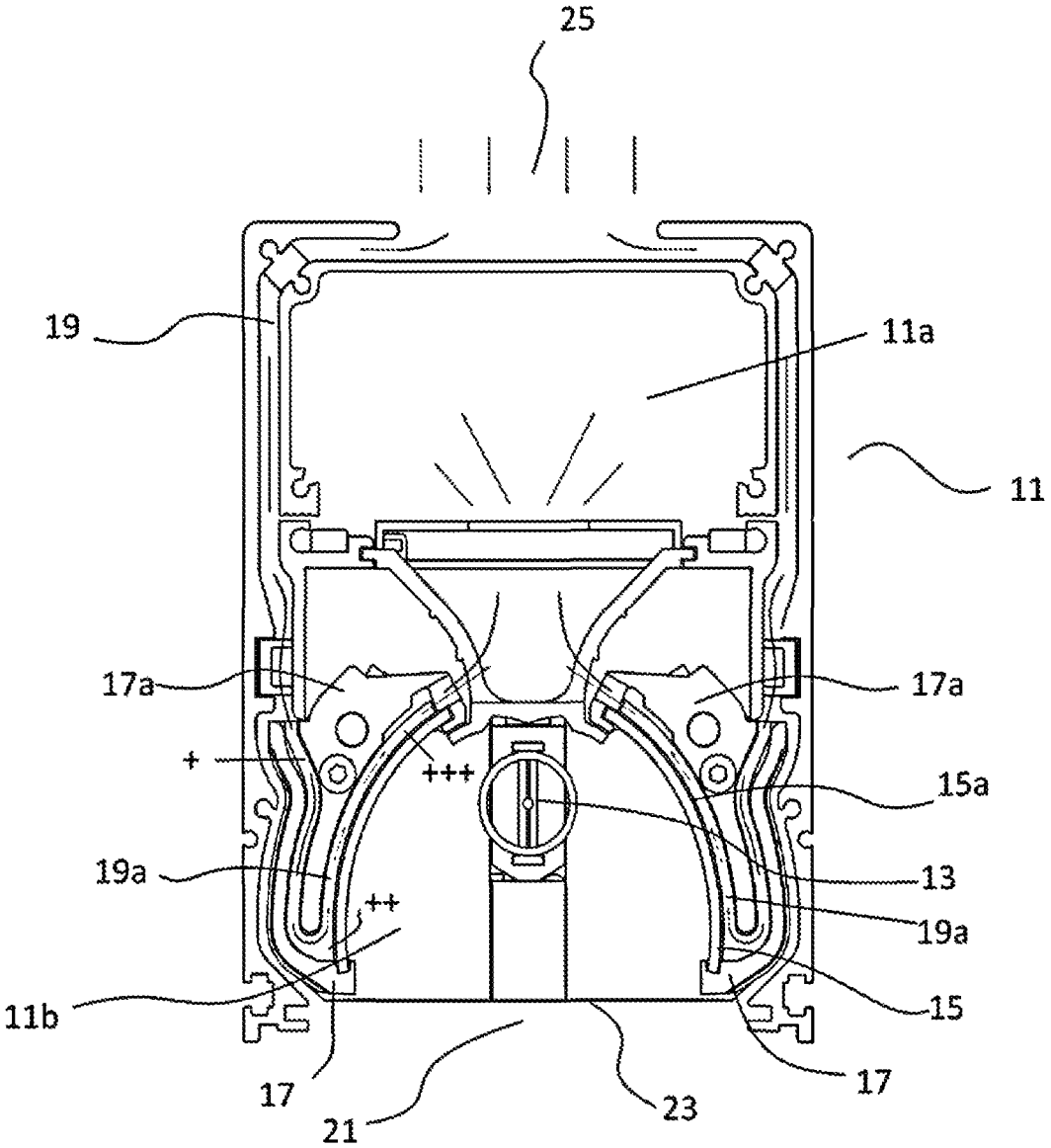
FIG. 4 is a schematic cross-sectional view showing the air flow path through the ink curing apparatus with the shutters in an open position; and, FIG. 5 is a schematic cross-sectional view showing the air flow path through the ink curing apparatus with the shutters in a closed position.
Figure 5:
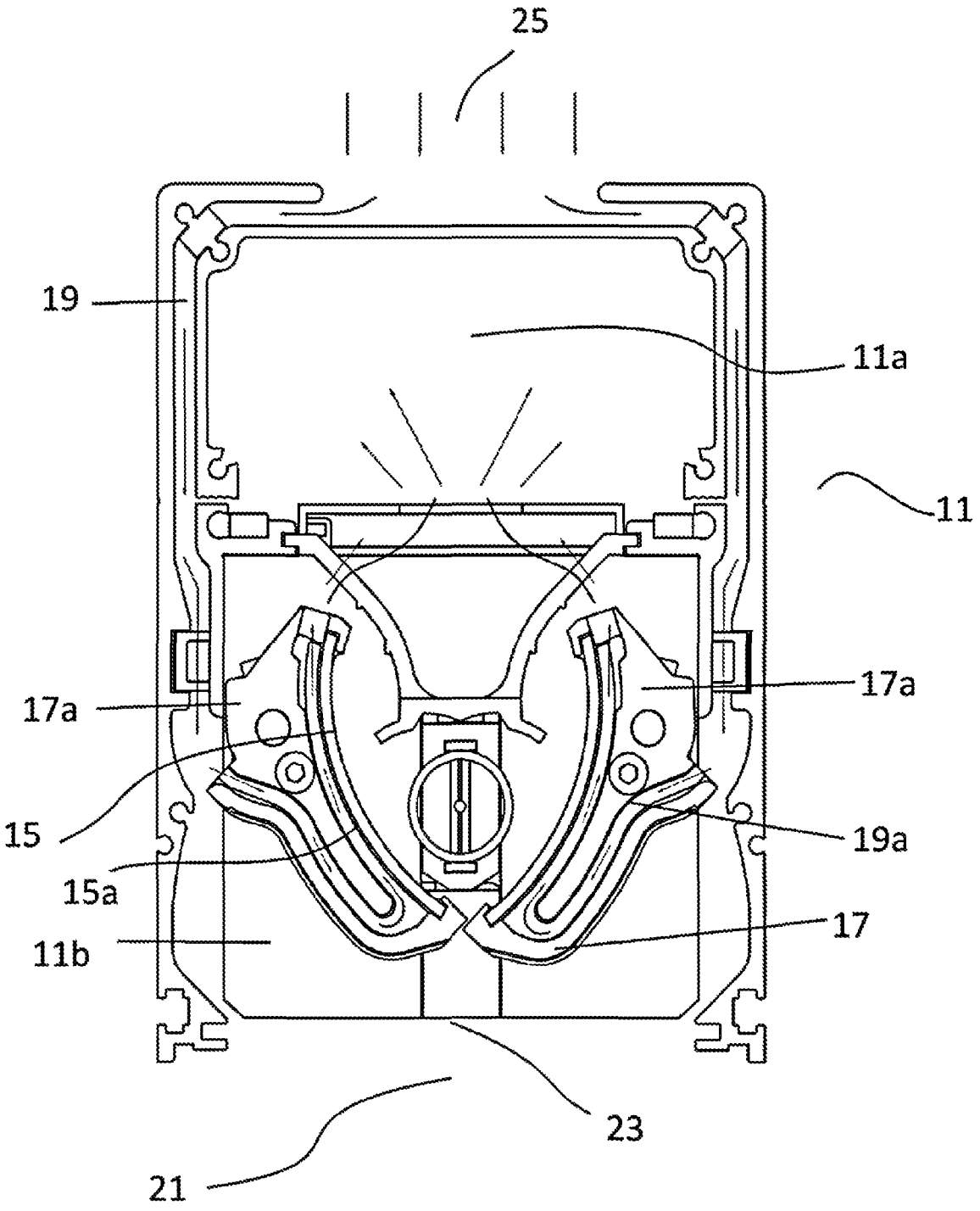

Referring to FIGS. 1 and 2, the ink curing apparatus comprises a housing 11 with upper 11*a* and lower chambers 11*b*. The upper chamber 11*a* houses a fan (not shown) to draw air into the apparatus through an inlet 25. In alternative embodiments, the apparatus comprises a duct to blow air into the system. The cooling system of the apparatus is connected to an external heat exchanger (not shown). Referring to FIGS. 4 and 5, an air passage 19 extends around the inner face of the housing 11. In use, the air passage 19 allows for a "cool casing"; whereby the outer surface of the housing 11 is cool enough to be touched, which assists in the removal and insertion of the apparatus.

The lower chamber 11*b* of the apparatus houses a lamp 13 surrounded by two reflectors 15. Each reflector 15 is held in place by an extruded shutter 17. The extruded shutter 17 is hinged and is moveable between an open position exposing the lamp, shown in FIG. 1 and a closed position concealing the lamp, shown in FIG. 2. Each reflector 15 is made of glass with a dichroic coating and can be removed from the shutter 17 for repair or replacement. The shutter 17 is extruded from aluminium and comprises a hinged member 17*a* running substantially along the length of the rear face 15*a* of the reflector 15. It is to be understood that the rear face 15*a* of the reflector is the face that is furthest from and not directly exposed to the lamp 13.

As shown in FIGS. 1 and 2, the shutter 17 is extruded to provide a continuation 19*a* of the air flow passage 19 along substantially the entire surface area of the rear face 15*a* of the reflectors 15. Furthermore, this air flow passage 19*a* extends around the hinged members 17*a* of the extruded shutters 17. The curved shape and positioning of the shutters 17 with respect to the lower chamber 11*b* ensure that the air flow passage is unobstructed for cooling regardless of whether the shutters 17 is in the open or closed position. The shape of the extruded shutters 17 also ensures that the flow of ambient air is directed around the hinged members 17*a* and across substantially the entire surface area of the reflectors 15, i.e. the hottest parts of the apparatus.

As shown in FIG. 1, when the shutter 17 and reflectors 15 are in an open position a curing aperture 21 is defined below the lamp 13 and between the reflectors 15. A quartz plate 23 extends across the base of the lower chamber 11*b* of the ink curing apparatus 11 and across the curing aperture 21. The quartz plate 23 prevents the ingress of contaminants into the apparatus and protects the lamp 13, reflector 15 and other working parts.

Figure 3:
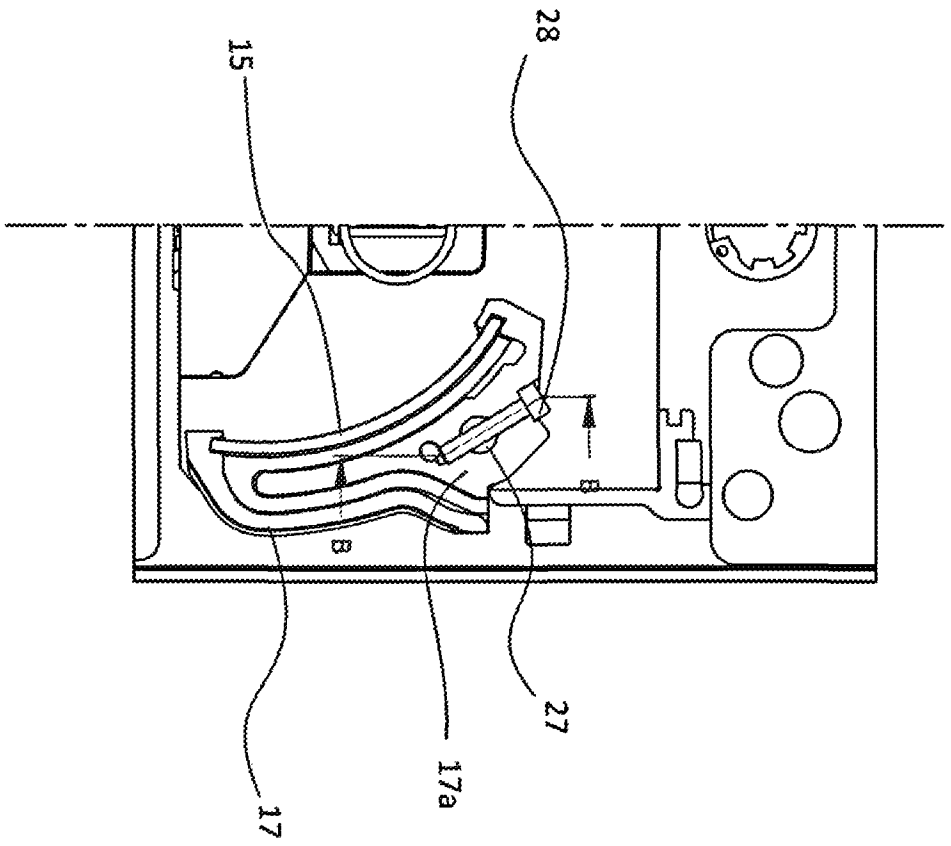
FIG. 3 is a cross-sectional view along the length of the ink curing apparatus of FIGS. 1 and 2 and through a fixing pin, showing the arrangement of a drive pin and fixing pin securing the reflector.

As shown in FIG. 3, the moveable shutters/reflectors 15/17 are secured to the apparatus by a centrally fixed drive pin 27. The drive pin is centrally fixed to the moveably shutters/reflectors by a fixing pin 28. As shown in FIGS. 1 and 2 each shutter 17, which is integral with the reflector 15, is movable between an open position, exposing the quartz plate 23 and substrate (not shown) to UV radiation emitted by the lamp 13, and a closed position shielding the quartz plate 23 and substrate from UV radiation emitted by the lamp 13. When the apparatus is in use and the lamp 13 emits UV radiation, the reflectors 15 will be heated and expand. The centrally positioned fixing pin 28 does not restrict the expansion of the reflectors 15 along their length. Furthermore, the expansion of the reflectors is significantly reduced by the improved cooling system of the present invention.

Referring to FIGS. 1 and 4, in use the shutter 17 and reflectors 15 are in an open position. The lamp 13 emits UV radiation, which is reflected from the lamp-facing surfaces of the reflectors 15 and is directed through the quartz window 23 onto a substrate (not shown) beneath the apparatus. The radiation is focussed from the lamp 13 directly across the entire curing aperture 21 so that the ink is dried/cured uniformly across the surface of the substrate.

Referring to FIG. 4, when the apparatus is in use, a proportion of the radiation also passes through the reflector 15 heating both the rear face 15*a* of the reflector and the hinged member 17*a* of the shutter 17. The lamp 13 emits heat at around 750° C. during the curing process and the hottest parts of the apparatus during use are those closest to the lamp 13. As indicated in FIG. 4 by the symbols, "+", "++", "+++", the hottest parts of the apparatus, including the shutter assembly 17 are the upper reflector surfaces marked "+++", the lower surface of the reflectors marked "++" and also the surface of the hinged member 17*a*, marked "+".

To ensure the safety and maximise the efficiency of the lamp, ambient air is drawn through an inlet 25 in the upper chamber 11*a* of the apparatus by a fan (not shown). Cool air flows into the apparatus 11 through the inlet 25 and passes along the air passage 19 around the inner face of the housing 11. The air passes through an inlet in the lower chamber 11*b* into the air flow passage 19*a* of the extruded shutter 17. The ambient air is gradually heated as it passes along the air flow passage 19*a* around the hinged member 17*a* and the rear face of the reflector 15*a*. The air passes along substantially the full surface area of each reflector's surface 15*a* to maximise the heat that is removed from the apparatus. The air that has been warmed by the extruded shutter 17 and the reflector 15, rises up and out of the apparatus 11 through the outlet/inlet 25. The flow of air carrying heat out of the apparatus is directed by the shape of the extruded shutter 17 to avoid any interference with the UV radiation emitted from the lamp 13, which is incident on the surface of the reflectors 15.

Referring to FIG. 5, when the apparatus is switched off, each shutter/reflector 15/17 moves to a closed position. The power to the lamp 13 is reduced when the apparatus is not in use and the quartz plate 23 and substrate are shielded from any radiation emitted from the lamp 13 by the shutter/reflector 15/17 in their closed position. Even with a reduction in the radiation emitted from the lamp, the surfaces of the shutter 17 and the reflector 15 absorb a significant amount of heat.

As shown in FIG. 5, with the shutter/reflector 15/17 assembly in a closed position, the air flow passage 19*a* still provides for the flow of ambient air around substantially the entire surface area of the shutters 17 and the rear surface of the reflectors 15*a*. With the shutters 17 in a closed position it is important that cooling continues to prevent the shutter 17 retaining too much heat. Thus, when the apparatus 11 is switched on again it is cooler and the burden to cool the apparatus during further use is reduced. The much improved cooling of the apparatus 11 when the apparatus is switched off also allows for the possibility to leave the lamp 13 on when the shutters 17 are closed and the apparatus 11 is in a "standby" mode. This then reduces the time required to heat up the lamp 13 for further use.

The above described embodiment has been given by way of example only, and the skilled reader will naturally appreciate that many variations could be made thereto without departing from the scope of the claims. For example, in an alternative embodiment of the present invention the apparatus comprises fixed reflectors and a separate moveable shutter to shield the substrate when the apparatus is not in use. It is envisaged that the fixed reflectors would be surrounded by an air flow passage across substantially their full surface area. The flow of air across the maximum surface area of the reflector provides much improved cooling of the apparatus even when the shutter is not integral with the reflector.

The invention claimed is:

1. An ink curing apparatus comprising a UV light source; at least one moveable shutter, which is moveable about the longitudinal axis of the UV light source; and at least one reflector; wherein at least one air passage is defined along substantially the entire surface area of the rear face of said at least one reflector, wherein the at least one air passage also passes along a substantial part of the surface area of said at least one shutter, such that the apparatus is cooled when a said shutter is both open and closed, and wherein each reflector is connectable to a shutter and an air passage is defined between each shutter and the reflector to which it is connected.

2. An ink curing apparatus according to claim 1 comprising at least two shutters.

3. An ink curing apparatus according to claim 1 comprising at least two reflectors.

4. An ink curing apparatus according to claim 1 wherein each reflector is removably connected to a said shutter.

5. An ink curing apparatus according to claim 1 wherein said one or more reflectors is/are moveable.

6. An ink curing apparatus according to claim 1 wherein a curing aperture is defined between the reflectors and the ink curing apparatus further comprises an inlet to a said air passage, wherein the inlet is positioned away from the curing aperture.

7. An ink curing apparatus according to claim 1 wherein said at least one reflector is formed from glass or aluminium.

8. An ink curing apparatus according to claim 1 wherein said at least one reflector is coated to maximise UV reflectivity and minimise IR reflectivity.

9. An ink curing apparatus according to claim 1 wherein said at least one reflector is movably connected to the apparatus by means of at least one drive pin positioned along the length of the reflector.

10. An ink curing apparatus according to claim 9 wherein said at least one reflector is fixed to the drive pin by a fixing pin positioned substantially half way along the length of said reflector.

* * * * *